US006483260B1

(12) United States Patent
Flory, IV

(10) Patent No.: US 6,483,260 B1
(45) Date of Patent: Nov. 19, 2002

(54) APPARATUS FOR OPERATING RESPECTIVE SINGLE LAMPS AMONG MULTIPLE LAMPS COUPLED TO THE SAME BALLAST

(75) Inventor: Isaac Lynnwood Flory, IV, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/909,839

(22) Filed: Jul. 23, 2001

(51) Int. Cl.[7] ..... H05B 41/00

(52) U.S. Cl. ..... 315/325; 315/320; 315/315; 315/88

(58) Field of Search ..... 315/312, 315, 315/320, 322, 324, 325, 193, 194, 88, 89, 90

(56) References Cited

U.S. PATENT DOCUMENTS

| | | | | | |
|---|---|---|---|---|---|
| 3,562,580 | A | | 2/1971 | Blomgren et al. | 315/88 |
| 3,676,734 | A | * | 7/1972 | Shimizu et al. | 315/106 |
| 3,790,846 | A | | 2/1974 | Morris | 315/91 |
| 4,475,062 | A | | 10/1984 | Radenkovich et al. | 315/88 |
| 4,587,600 | A | * | 5/1986 | Morten | 362/219 |
| 4,862,038 | A | | 8/1989 | Morten | 315/86 |
| 4,945,279 | A | | 7/1990 | Leu | 315/201 |
| 5,128,595 | A | | 7/1992 | Hara | 315/312 |
| 5,276,385 | A | * | 1/1994 | Itoh et al. | 313/336 |
| 5,430,354 | A | | 7/1995 | Garbowicz et al. | 315/88 |
| 5,610,448 | A | | 3/1997 | Dattilo | 307/39 |
| 6,011,358 | A | * | 1/2000 | Knobloch et al. | 315/224 |
| 6,100,653 | A | * | 8/2000 | Lovell et al. | 315/248 |
| 6,157,140 | A | | 12/2000 | Rodrigue | 315/241 S |

* cited by examiner

*Primary Examiner*—Haissa Philogene
(74) *Attorney, Agent, or Firm*—Aisha Ahmad; Stacey J. Longanecker; Alfred N. Goodman

(57) ABSTRACT

An apparatus and method are provided for operating one of a plurality of lamps employed within a luminaire via a single ballast, thereby extending the operational life of the luminaire. The operating lamp disables the lamps downstream from itself by preventing current from conducting through lamps other than the operating lamp. The lamps upstream from the operating lamp typically lack a sufficient voltage for ignition and operation. However, if any of the upstream lamps begin to operate, the lamps operating downstream cease to operate. In the event that two lamps begin to operate in an asymmetric manner, a capacitor is preferably provided to maintain a reverse voltage with respect to the output of the ballast, thus ensuring reduced voltage across the rectified lamps until one lamp extinguishes and the second lamp begins to operate.

25 Claims, 3 Drawing Sheets

APPARATUS FOR OPERATING RESPECTIVE SINGLE LAMPS AMONG MULTIPLE LAMPS COUPLED TO THE SAME BALLAST

BACKGROUND OF THE INVENTION

High intensity discharge luminaires, hereinafter referred to as HID luminaires, as well as fluorescent, and incandescent luminaires are commonly installed at high locations at commercial or industrial facilities such as on the ceiling of a warehouse or plant, or on light poles in a parking lot or stadium. In addition, HID luminaires can include, but are not limited to, metal halide (MH) lamps, and high pressure sodium (HPS) lamps. Some MH luminaires and all HPS luminaires use pulses from a high voltage source such as an ignitor circuit to ignite the lamp.

In many applications, the HID, fluorescent, and incandescent luminaires can be elevated on the order of thirty feet or more above the ground or floor of a commercial or industrial facility. The elevation of the luminaires makes servicing inconvenient and time consuming since service personnel must ascend to considerable heights in order to gain access to the luminaires, assess the problem and then repair or replace the defective components. Since the lamps in a luminaire are frequently the defective component, it would be useful to provide spare lamps in a luminaire that are automatically switched on as needed, thereby reducing the need to replace these components. Therefore, a need exists for increasing the serviceable life of a fluorescent, high intensity discharge, or incandescent luminaire by connecting multiple lamps to a single ballast, yet allowing one lamp to operate at any given time. Accordingly, a luminaire that requires lamp maintenance every 8000 hours is transformed into a luminaire that is serviced every N×8000 hours, where N is the number of lamps coupled to the single ballast, and limited by the physical capacity of the luminaire.

U.S. Pat. No. 3,790,846 by Morris discloses an automatic load monitoring and transfer circuit and is representative of the conventional methods for increasing luminaire service life. The apparatus disclosed in U.S. Pat. No. 3,790,846 automatically switches to the secondary load, upon failure of the primary load, thereby extending luminaire service time by twice that of a typical incandescent luminaire. The apparatus disclosed in U.S. Pat. No. 3,790,846, however, employs an incandescent luminaire and does not have the necessary internal circuitry to facilitate operation of a fluorescent or, a HID luminaire. In addition, the apparatus disclosed in U.S. Pat. No. 3,790,846 ensures that the primary load is activated before the secondary load via phase shifting a load current, thus facilitating proper sequencing of the loads. Accordingly, the invention disclosed in the Morris patent is not equipped to operate with more than two incandescent lamps. Therefore, a need exists for an apparatus for operating respective ones of a plurality of incandescent, fluorescent or, high intensity discharge luminaires.

SUMMARY OF THE INVENTION

The present invention overcomes the deficiencies of existing devices that enable operation of a selected lamp, and realizes a number of advantages over these devices. An apparatus for operating one of a plurality of lamps is provided in accordance with the present invention that extends the service life of the luminaire, by operating one lamp, therein, at a given time.

In accordance with an aspect of the present invention, the lamp selection apparatus is employed within a luminaire comprising a single ballast for a plurality of lamps therein. This allows the luminaire service life to be extended, at least by the number of lamps within the luminaire.

In accordance with another aspect of the present invention, the lamp selection apparatus is configured such that it does not allow multiple lamp rectification. In other words, specific components are provided in the present invention that inhibit the upstream lamps from turning on and off in an alternating half-wave sequence.

In accordance with an aspect of the present invention the lamp selection circuitry is configured to be operable for multiple lamp types. For example, the present invention employs fluorescent luminaires.

In accordance with an aspect of the present invention, the apparatus for operating one of a plurality of lamps via a single ballast comprises a rectifying circuit and a gating circuit. The plurality of lamps are connected in parallel and comprise the operating lamp and any upstream lamps connected between the operating lamp and the ballast and any downstream lamps connected on the other side of the operating lamp. The rectifying circuit rectifies the lamp current from the operating lamp that provides illumination. The gating circuit then stops conduction of any downstream lamps, ensuring operation of a single lamp.

Another embodiment of the apparatus incorporates the rectifying circuit and the gating circuit, as well as a capacitive circuit. In this embodiment, the plurality of lamps comprise the operating lamp and all upstream lamps, that is, those lamps between the ballast and the operating lamp, and the downstream lamps. The capacitive circuit is placed in series with the output of each of the lamps to store energy associated with the rectified current and reduce the associated voltage from the ballast to the upstream lamps. This embodiment is provided to inhibit multiple upstream lamps from rectifying, thus turning on and off in an alternating half-cycle sequence.

The present invention also provides a method for operating one of a plurality of lamps via a single ballast. The method comprises, first, rectifying a signal through one or more rectifying circuits from an operating lamp, thereby conditioning the signal for use as a gating signal. Gating of the associated thyristors is then performed to prevent operation of the lamps connected downstream from the operating lamp.

In accordance with another embodiment, the method comprises the steps of rectifying and gating the signal, as well as, storing energy in the capacitive circuit from the one of the lamps connected upstream from the operating lamp. In addition, a reverse voltage is provided by the capacitive circuit, with respect to the ballast, thus reducing the voltage across each of the upstream lamps. The lamps subsequently extinguish as a result of the reduced voltage until only one of the lamps remains in an operational state.

BRIEF DESCRIPTION OF THE DRAWINGS

These and other aspects, advantages and novel features of the invention will be more readily appreciated from the following detailed description when read in conjunction with the accompanying drawings, in which.

DETAILED DESCRIPTION OF THE PREFERRED EMBODIMENT

Figure 1:
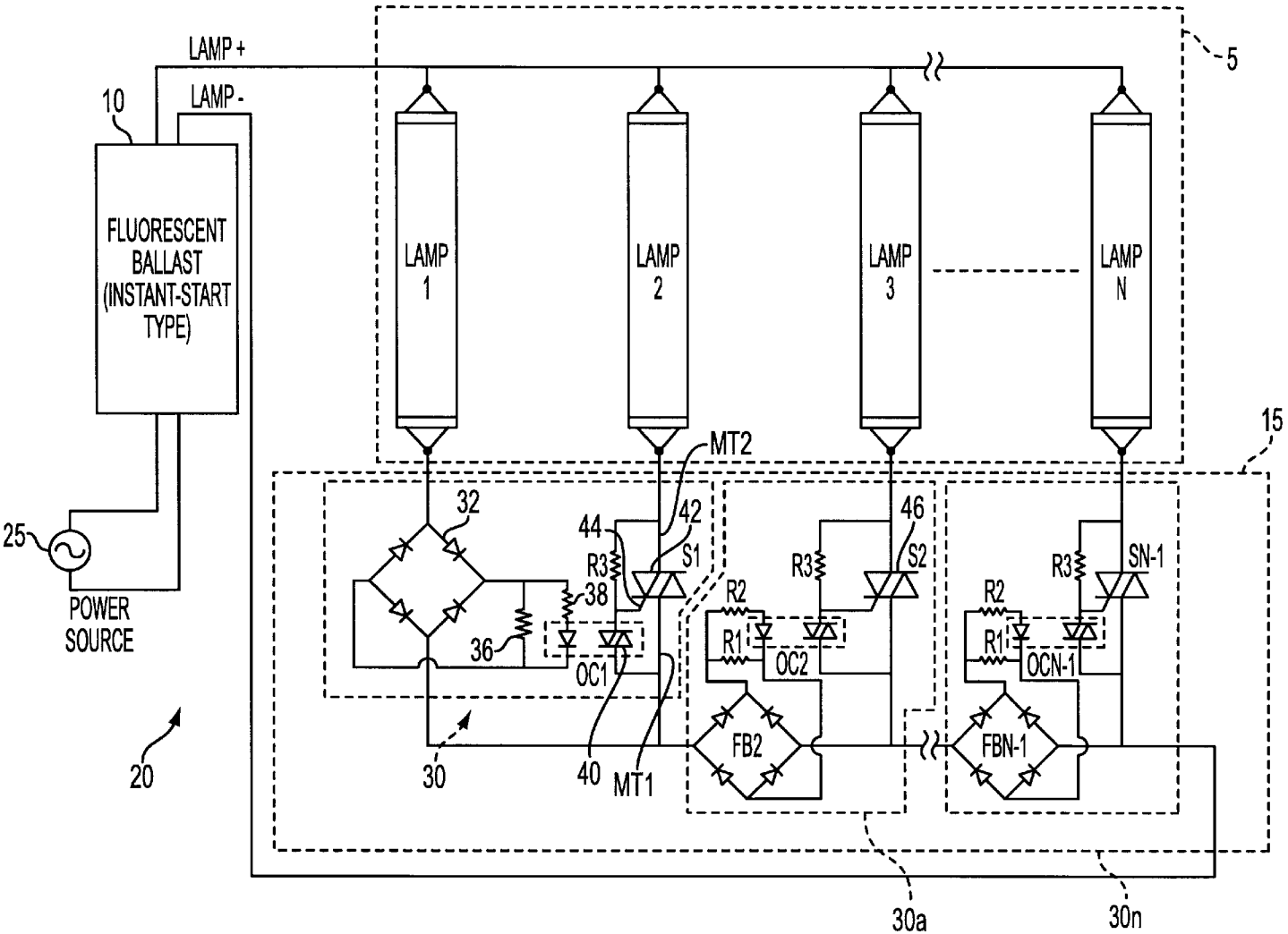
FIG. 1 is a schematic circuit diagram of the lamp operation circuitry constructed in accordance with an embodiment of the present invention.

In accordance with the present invention, an apparatus is provided to connect multiple discharge lamps to a single ballast and to operate only one lamp at any given time. The present invention therefore increases the service life of a luminaire. By way of an illustrative example FIG. 1 depicts a luminaire 20 comprising multiple instant start fluorescent lamps 5 (i.e., lamp 1, lamp 2, . . . , lamp N) connected to a single lamp instant-start fluorescent ballast 10, and circuitry 15 that allows one lamp to operate at any given time. In other words, as lamp 1 ceases to operate, lamp 2 begins operating and prevents conduction of current, via circuitry 15, to lamps 3 through N, for example. An advantage of the present invention is that the serviceable life of a luminaire 20 is extended by increasing the number of lamps N employed therein. The number of lamps is limited by the physical capacity of the luminaire 20.

With continued reference to FIG. 1, the luminaire 20 employs a power supply 25 coupled to a fluorescent ballast 10 in a conventional manner. The ballast 10 is preferably an instant start type such that current travels through one wire that is tied to the filament of each lamp and connected at a single point so that lamp current is routed through a single wire to facilitate operation of circuitry 30. Accordingly a single ballast 10 can operate multiple lamps 5. The ballast 10 is either a single lamp ballast or a multi-lamp ballast, although only one lamp operates at a given time. Circuitry indicated generally at 30 is coupled to lamp 1 to facilitate blocking downstream current to lamps 2-N, thus allowing only lamp 1 to operate. The number of circuits 30 employed by the luminaire 20 of the present invention is one less than the number of lamps 5. That is, the number of individual circuits 30 is N−1, where N is the total number of lamps 5. The last lamp N does not need accompanying circuitry 30 as there are no lamps downstream from the lamp N.

It should be noted that the present invention does not facilitate operation of a specific lamp. Accordingly, it is possible that upon initial application of power, lamp 3 operates before lamp 1 or lamp 2. In such a case, lamps 1 or 2 may begin to operate, as well since they are able to conduct current. However, the ballast preferably provides a reduced open circuit voltage to lamp 1 and 2 when lamp 3 strikes and operates thus making starting an upstream lamp (e.g., lamps 1 or 2) more difficult but not impossible, as detailed below.

Figure 4:
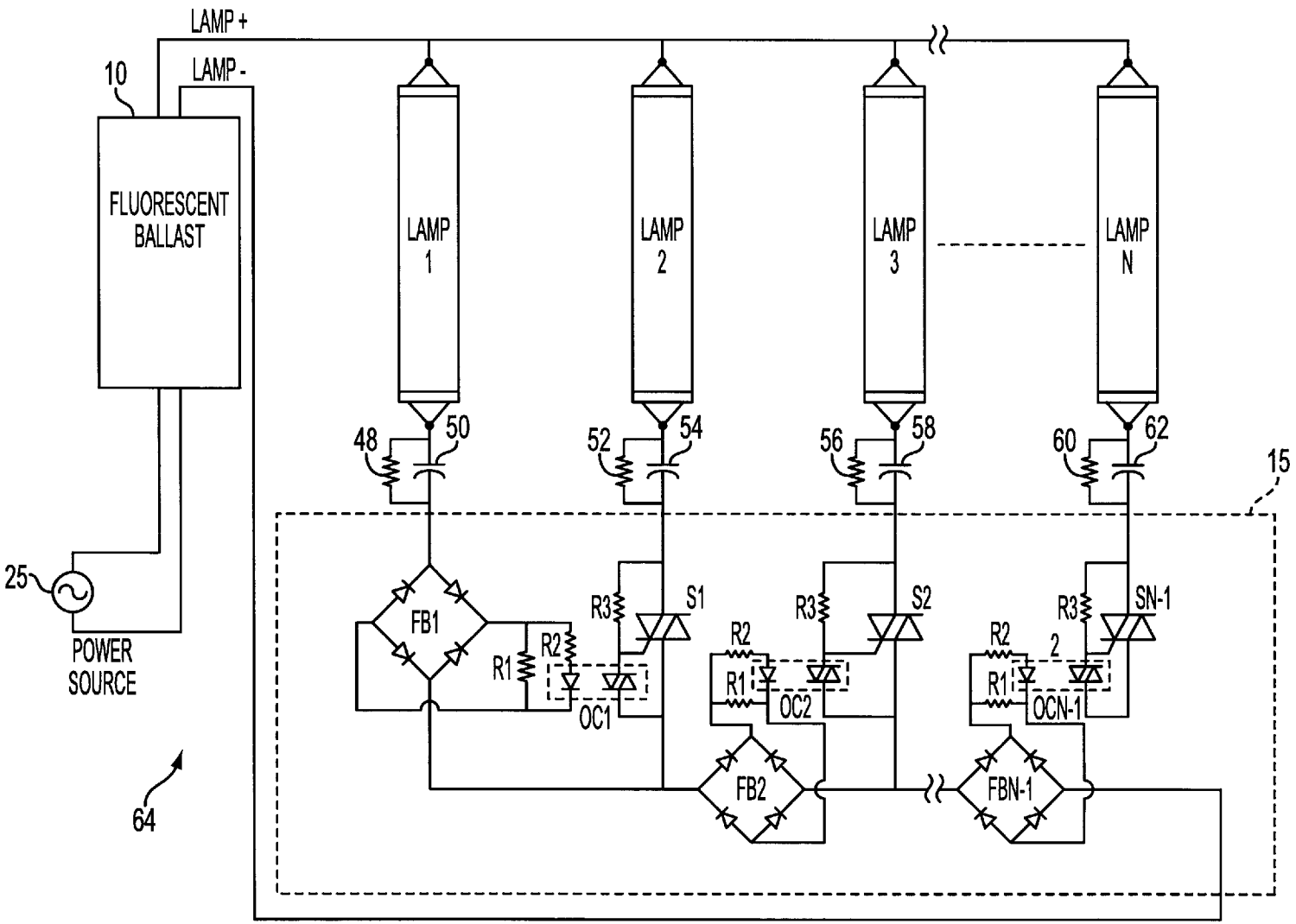
FIG. 4 is a schematic circuit diagram of another embodiment of the operating lamp operation circuitry constructed in accordance with another embodiment of the present invention.

Another embodiment of the present invention is depicted in FIG. 4 and discussed in further detail below. Briefly, the luminaire prevents multiple lamp rectification that occurs when the lamps 15 have aged to some unknown degree. For example, if lamp 3 is operating lamps 4-N are prevented from operating by the circuitry 15. Lamps 1 and 2, however, are still able to conduct. In this case, lamps 2 and 3 can rectify the incoming power supplied by power source 25 via ballast 10. This rectification is evident to the user by the fact that lamps 2 and 3 are turning on and off in an alternating half-wave sequence. This is an undesirable condition since it reduces the lamp life of a given lamp as material from one filament will be deposited on the other filament thus prematurely depleting the emission mix.

With continued reference to FIG. 1, there are essentially three scenarios that occur in operating one of the lamps 5 of the present invention. First, for exemplary purposes, lamp 1 starts to operate before any of the other lamps 2 through N. Second, any lamp 2 through N can start to operate before lamp 1. Finally, the operating lamp approaches the end of its operating life, another lamp, either upstream or downstream of the extinguished lamp, becomes the operating lamp. This continues until all of the lamps reach the end of their operating lives. Accordingly, the service life of the luminaire 20 is extended by N, that is, the number of lamps, therein.

For illustrative purposes, the operation of lamp 1 before lamps 2 through N, will now be described. Lamp 1 initiates operation in a conventional manner via ballast 10. Current flows from lamp 1 to the full-wave bridge rectifier 32 for rectification. Current from the rectifier 32 is then provided to the input of an optocoupler 40 via resistors 36 and 38. The resistors 36 and 38 are preferably in a parallel combination, where resistor 38 is in series with the optocoupler 40, and limit the input current to so as not to exceed the rating for the light emitting diode (LED) of optocoupler 40. The optocoupler 40 provides an electrically isolated signal coupled between a photothyristor and a LED in a conventional manner. The LED emits light when current passes through which in turn activates the photothyristor upon receiving light from the LED. The photothyrisotor in turn provides a low impedance current path at the output of optocoupler 40. The current passing through the output of optocoupler 40 prevents the gating of a triac 42. Specifically, the octocoupler 40 is energized via current through resistor 38, thus taking the gate 44 of triac 42 to MT2 of triac 42. Accordingly, optocoupler 40 shorts, thus preventing triac 42 from conducting current to the subsequent downstream lamp 2, for example, and ensuring operation of the lamp 1. This operation occurs for each subsequent circuit 30*a* through N.

The second situation, as mentioned above, occurs when any lamp other than lamp 1 operates first. In this case, the operating lamp disables all lamps downstream from itself in a manner consistent with an embodiment of the present invention, as described above. However, all of the lamps upstream of the operating lamp are not disabled as current is still able to flow through each of the upstream lamps. Accordingly, the upstream lamps are either at the end of their serviceable life or able to conduct. Therefore, it is possible that one or more upstream lamps will ignite if there is sufficient voltage across the lamp. However, the likelihood of such an event is reduced by the very nature of conventional fluorescent lamps 5. Specifically, the lamps 5 need a sufficient open circuit voltage provided by the ballast 10 to initiate operation. However, in the event that an additional upstream lamp ignites and begins operation, the new operating lamp disables all downstream lamps from itself in a manner consistent with an embodiment of the present invention, as described above. This ensures that only one lamp operates at any given time. Accordingly, for example, if lamp 2 is initially operating, and then lamp 1 suddenly begins operating due to adequate voltage occurring across lamp 1, the present invention ensures that the operating lamp 1 disables lamp 2, thus allowing only one lamp (i.e., lamp 1) to operate.

Figure 3:
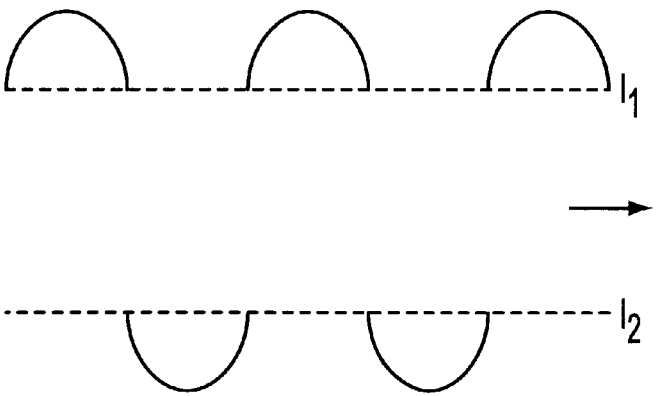
FIG. 3 illustrates a rectified waveform within the lamps of FIG. 2 in accordance with an embodiment of the present invention.
Figure 2:
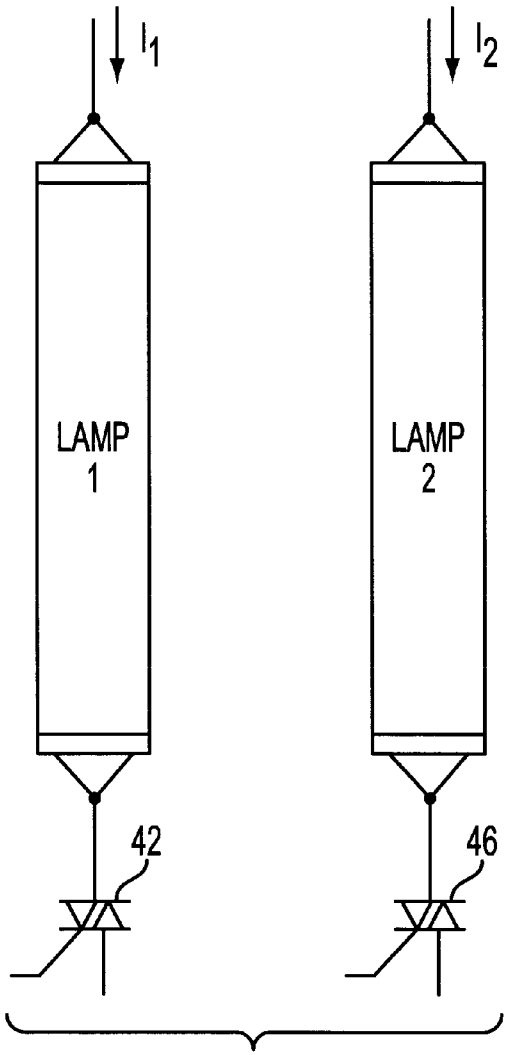
FIG. 2 is diagram illustrating double lamp rectification in accordance with an embodiment of the present invention.

In addition to the situation where an upstream lamp begins to operate after a downstream lamp was initially operating, there is also the issue of lamp rectification. As mentioned above, occasionally, after the lamps have experienced a significant number of starts, for example hundreds of starts, and after the lamps have aged to some unknown degree, two lamps begin to operate simultaneously but at a lower than expected output level. Accordingly, two lamps are operating in an alternating half-cycle sequence as current (I) is traveling through both lamps as depicted in FIG. 2. The two lamps are conducting every other half-cycle, as shown in FIG. 3, producing a flashing sequence that appears to the human eye as merely a low output lamp, whereby lamp 1 operates for an instant, then lamp 2 operates and again lamp 1 and so on. This type of lamp rectification is undesirable as it reduces the serviceable life of the operating lamps by depositing material from the filament of each operating lamp to the opposing filiament and prematurely depleting the emission mix, as well as having two lamps operating at one time.

Another embodiment of the present invention addresses this issue of lamp rectification. Resistor 48 and capacitor 50 are added to circuitry 15, as shown in FIG. 4, to stop the current in lamp 1 and lamp 2 from rectifying or becoming asymmetric, as depicted in FIG. 3. Specifically, the voltage developed across capacitor 50 acts as a back voltage or reverse voltage across lamp 1, as compared to the voltage across ballast 10, and opposes the electromotive force (EMF) charge provided by the ballast 10, thereby reducing the net voltage across lamp 1 and terminating its operation. In other words, capacitor 50 charges quickly due to the unidirectional current and therefore does not allow the passage of current sufficient to operate the lamp 1. The first of the lamps associated with capacitors 50 or 54 (i.e., lamps 1 and 2, respectively) that extinguishes allows for the bidirectional flow of current through the remaining operating lamp, thereby allowing only one lamp to operate at a given time. The capacitor 50 is sized such that the voltage drop across it is minimal during steady-state bidirectional operation. In addition, the resistor 48 is preferably provided as an energy discharge path in the event that a residual charge is present within capacitor 50, for example. Accordingly, any potential hazard of receiving electric shock by touching the luminaire 64 is minimized.

Typical values and part numbers for the components of FIGS. 1 and 4 are shown in Table 1, below.

| | |
|---|---|
| Capacitors 50, 54,58, and 62 | 0.15 microfarads |
| Full wave bridges 32 through FB N-1 | Motorola 3N250 |
| Optocoupler OC1 through OC N-1 | Motorola MOC3023 |
| Triac S1 through SN-1 | MAC218 |
| Resistors 36 and R1 | 20 Ω |
| Resistors 38 and R2 | 470 Ω |
| Resistors R3 | 47 kΩ |
| Resistors 48, 52, 56, and 60 | 10 MΩ |

It should be noted that circuitry 15 of FIG. 1 is preferably employed with any discharge or incandescent lamp due to the use of low-frequency ballasts in those types of luminaires. If the luminaire employs a high-frequency ballast, then the embodiment of the present invention depicted in FIG. 4 is preferred.

Although only several exemplary embodiments of the present invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. An apparatus for operating one of a plurality of lamps via a single ballast, and wherein the plurality of lamps are connected in parallel and comprise the lamp that is operating and any upstream lamps connected between the lamp and the ballast and any downstream lamps connected on the other side of the lamp, the apparatus comprising:

a rectifying circuit operable to rectify a current from one of said plurality of lamps that is operating; and a gating circuit operable to prevent conduction of all said downstream lamps.

2. An apparatus as claimed in claim 1, said apparatus further comprising:

a capacitive circuit coupled to one of said upstream lamps to store energy and reduce the associated voltage from said ballast to said upstream lamp and allow said operating lamp to be the only one of said plurality of lamps in operation.

3. An apparatus as claimed in claim 2, wherein said capacitive circuit comprising a capacitor and a resistor connected in parallel.

4. An apparatus as claimed in claim 1, wherein said ballast comprises an instant start ballast.

5. An apparatus as claimed in claim 1, wherein said rectifying circuit comprises a full-wave bridge.

6. An apparatus as claimed in claim 1, said apparatus further comprising:

a current limiting circuit coupled to said rectifying circuit to limit current of said output; and an isolating circuit coupled to said current limiting circuit operable to electrically isolate said output received from said rectifying circuit.

7. An apparatus as claimed in claim 6, wherein said current limiting circuit comprises at least one resistor.

8. An apparatus as claimed in claim 1, wherein said gating circuit comprises an optocoupler and a triac.

9. An apparatus for operating one of a plurality of lamps, the apparatus comprising:

a lamp;

a single ballast wherein said plurality of lamps are connected in parallel and comprises said lamp that is operating and any upstream lamps connected between said lamp and said ballast and any downstream lamps connected on the other side of said lamp;

a rectifying circuit operable to rectify an output from one of said plurality of lamps that is operating; and a gating circuit operable to stop conduction of all said downstream lamps.

10. An apparatus as claimed in claim 9, wherein said rectifying circuit comprises a plurality of said rectifying circuits, and said gating circuit comprises a plurality of said gating circuits.

11. An apparatus as claimed in claim 9, wherein said energy comprises a half-wave rectified signal from said upstream lamp.

12. An apparatus as claimed in claim 9, wherein said ballast is selected from the group comprising a single lamp ballast and a multi-lamp ballast.

13. An apparatus as claimed in claim 9, wherein said plurality of lamps are coupled in parallel.

14. A method for operating one of a plurality of lamps connected in parallel and operated via a single ballast, said method comprising the steps of:

rectifying the output from one of said plurality of lamps that is operating; and providing gating to circuitry controlling remaining ones of said plurality of lamps connected downstream of said operating lamp to prevent operation of said remaining ones of said plurality of lamps connected downstream of said operating lamp while said operating lamp operates.

15. A method as claimed in claim 14, further comprising the steps of:

storing energy from said plurality of lamps that is upstream of said operating lamp in a capacitive circuit; and providing a reverse voltage via said capacitive circuit, said reverse voltage being with respect to said ballast, to achieve reduced voltage across said upstream lamps, thus extinguishing said upstream lamps.

16. A method as claimed in claim 15, wherein said capacitive circuit comprises a capacitor and a resistor connected in parallel.

17. A method as claimed in claim 14, further comprising the step of:

limiting said output via a current limiting circuit for further conditioning said output.

18. An apparatus for operating a selected one of a plurality of lamps connected in parallel and operable via a single ballast, said apparatus comprising:

a first rectifying device coupled in series to the output of one of said plurality of lamps that is operating;

an isolating device coupled to an output of said first rectifying device;

a gating device coupled to said isolating device and in parallel with respect to said operating lamp, and said first rectifying device; and a second rectifying device coupled to said first rectifying device and operable with respect to another one of said plurality of lamps located downstream with respect to said operating lamp.

19. An apparatus as claimed in claim 18, further comprising:

a third rectifying device; and a capacitive device coupled in series between one of said plurality of lamps located upstream with respect to said operating lamp and said third rectifying device.

20. An apparatus as claimed in claim 19, said capacitive device comprising at least one capacitor in parallel with at least one resistor.

21. An apparatus as claimed in claim 18, wherein said first rectifying device comprises a full-wave bridge.

22. An apparatus as claimed in claim 18, wherein said isolating device comprises an optocoupler.

23. An apparatus as claimed in claim 18, further comprising a resistive device coupled to the output of said first rectifying device, said resistive device comprises at least one resistor.

24. An apparatus as claimed in claim 18, wherein said gating device comprises an optocoupler and a triac.

25. An apparatus as claimed in claim 18, wherein said second rectifying device associated with a second isolating device and a second gating circuit, and said second gating circuit operable to perform gating of output of said second isolating device to prevent operation of downstream lamps with respect to said another one of said plurality of lamps.

* * * * *